US007775613B2

(12) United States Patent
Williams

(10) Patent No.: US 7,775,613 B2
(45) Date of Patent: Aug. 17, 2010

(54) STORAGE ASSEMBLY

(75) Inventor: Ian R. Williams, Davisburg, MI (US)

(73) Assignee: Intier Automotive Inc., Newmarket, Ontario (CA)

( * ) Notice: Subject to any disclaimer, the term of this patent is extended or adjusted under 35 U.S.C. 154(b) by 736 days.

(21) Appl. No.: 11/682,418

(22) Filed: Mar. 6, 2007

(65) Prior Publication Data

US 2007/0228904 A1 Oct. 4, 2007

Related U.S. Application Data

(60) Provisional application No. 60/779,568, filed on Mar. 6, 2006.

(51) Int. Cl.
*E06B 1/00* (2006.01)

(52) U.S. Cl. ..... 312/321.5; 312/248; 312/325

(58) Field of Classification Search ..... 312/325, 312/321.5, 246, 248, 334.8, 323, 405.1; 248/291.1, 248/292.14; 220/521, 522, 500, 908, 909
See application file for complete search history.

(56) References Cited

U.S. PATENT DOCUMENTS 1,685,536 A * 9/1928 Beiger et al. ..... 312/334.8
3,140,136 A * 7/1964 Clark ..... 312/323
4,186,978 A * 2/1980 Thomson ..... 312/321.5
5,385,378 A 1/1995 Hakamada et al.
5,795,005 A 8/1998 Garfias et al.
6,129,401 A 10/2000 Neag et al.
6,585,871 B1 7/2003 Anzaki et al.
6,604,439 B2 8/2003 Gaukel
6,938,940 B1 9/2005 Lipke et al.
6,969,129 B2 11/2005 Ludwig et al.
7,051,613 B2 5/2006 Burton et al.

FOREIGN PATENT DOCUMENTS

EP 82219 * 6/1983 ..... 312/323
FR 2730186 A3 9/1996
WO WO02/14165 A1 2/2002

* cited by examiner

*Primary Examiner*—Hanh V Tran
(74) *Attorney, Agent, or Firm*—Honigman Miller Schwartz and Cohn LLP

(57) ABSTRACT

An assembly includes a housing, one or more telescoping brackets movably secured to the housing, and a door portion movably secured to the housing and the one or more telescoping brackets. A method for providing increased access to a storage compartment includes the steps of movably joining one or more telescoping brackets to a housing, movably joining a door portion to the one or more telescoping brackets and the housing, and moving the door portion to cause the one or more telescoping brackets to telescopingly project the door relative housing to provide access to a storage compartment.

8 Claims, 4 Drawing Sheets

STORAGE ASSEMBLY

RELATED APPLICATIONS

This application claims the benefit of earlier filed U.S. Provisional Application Ser. No. 60/779,568, filed Mar. 6, 2006, which is incorporated herein by reference in its entirety.

FIELD OF THE INVENTION

The present invention relates to an assembly including a housing, a door portion, and one or more telescoping brackets that connect the door portion to the housing.

BACKGROUND OF THE INVENTION

It is known in the art that storage compartments are commonly found in vehicles for storing any desirable item, such as, for example, maps, gloves, coins, pens, beverages, compact discs (CDs), digital music players, or the like. In some circumstances, neighboring obstructing components may limit the accessibility to items located within the storage compartment. Accordingly, a need therefore exists for an improved storage compartment design that overcomes the shortcomings of conventional storage compartments.

SUMMARY OF THE INVENTION

In accordance with the invention there is provided an assembly comprising a housing, one or more telescoping brackets movably secured to the housing, and a door portion movably secured to the housing and the one or more telescoping brackets.

In accordance with another aspect of the invention, the housing includes a first end wall, and a first pair of sidewalls extending from the first end wall to define a volume, wherein the door portion includes a second end wall, and a second pair of sidewalls extending from the second end wall to define a sub-volume that is less than but approximately equal to the volume of the housing. The one or more telescoping brackets and second pair of sidewalls of the door portion are defined by a substantially similar geometry to that of the first pair of sidewalls of the housing to permit the one or more telescoping brackets and door portion to be received by and nested within the volume defined by the housing.

In accordance with yet another aspect of the invention, the one or more telescoping brackets include a first arcuate channel, and a passage, wherein the door portion includes a second arcuate channel.

In accordance with a further embodiment of the invention, the assembly further comprises a first pin extending from the first pair of sidewalls of the housing, wherein the first pin extends through the first arcuate channel of the one or more telescoping brackets, and a second pin extending from the first pair of sidewalls of the housing, wherein the second pin extends through the passage of the one or more telescoping brackets and the second arcuate channel of the door portion.

In accordance with yet a further aspect of the invention, the door portion is defined to include a bottom wall, and a front wall, wherein the end wall, second pair of sidewalls, bottom wall, and front wall further define a storage compartment, wherein the front wall, end wall and second pair of sidewalls define an opening to the storage compartment.

In accordance with the invention there is further provided, a method for providing increased access to a storage compartment including the steps of movably joining one or more telescoping brackets to a housing, movably joining a door portion to the one or more telescoping brackets and the housing, and moving the door portion to cause the one or more telescoping brackets to telescopingly project the door relative housing to provide access to a storage compartment.

Furthermore, in accordance with the invention, there is provided an assembly including a housing, a door portion movably secured to the housing, and a means for telescopingly adjusting a positioning of the door portion relative a position of the housing.

In accordance with another aspect of the invention, the means includes one or more telescoping brackets that are movably secured to the housing, wherein the door portion is movably secured to the housing and the one or more telescoping brackets.

In accordance with yet another aspect of the invention, the housing includes a first end wall, and a first pair of sidewalls extending from the first end wall to define a volume, wherein the door portion includes a second end wall, and a second pair of sidewalls extending from the second end wall to define a sub-volume that is less than but approximately equal to the volume.

In accordance with yet a further aspect of the invention, the one or more telescoping brackets and second pair of sidewalls of the door portion are defined by a substantially similar geometry to that of the first pair of sidewalls of the housing to permit the one or more telescoping brackets and door portion to be received by and nested within the volume defined by the housing. The one or more telescoping brackets include a first arcuate channel, and a passage, wherein the door portion includes a second arcuate channel.

In accordance with another aspect of the invention, the assembly further comprises a first pin extending from the first pair of sidewalls of the housing, wherein the first pin extends through the first arcuate channel of the one or more telescoping brackets, and a second pin extending from the first pair of sidewalls of the housing, wherein the second pin extends through the passage of the one or more telescoping brackets and the second arcuate channel of the door portion. The door portion is defined to include a bottom wall, and a front wall, wherein the end wall, second pair of sidewalls, bottom wall, and front wall further define a storage compartment, wherein the front wall, end wall and second pair of sidewalls define an opening to the storage compartment.

BRIEF DESCRIPTION OF THE DRAWINGS

The disclosure will now be described, by way of example, with reference to the accompanying drawings, in which.

DETAILED DESCRIPTION OF THE PREFERRED EMBODIMENTS

The Figures illustrate an exemplary embodiment of an assembly defined by a housing and a door portion in accordance with an embodiment of the invention. Based on the foregoing, it is to be generally understood that the nomenclature used herein is simply for convenience and the terms used to describe the invention should be given the broadest meaning by one of ordinary skill in the art.

Figure 1:
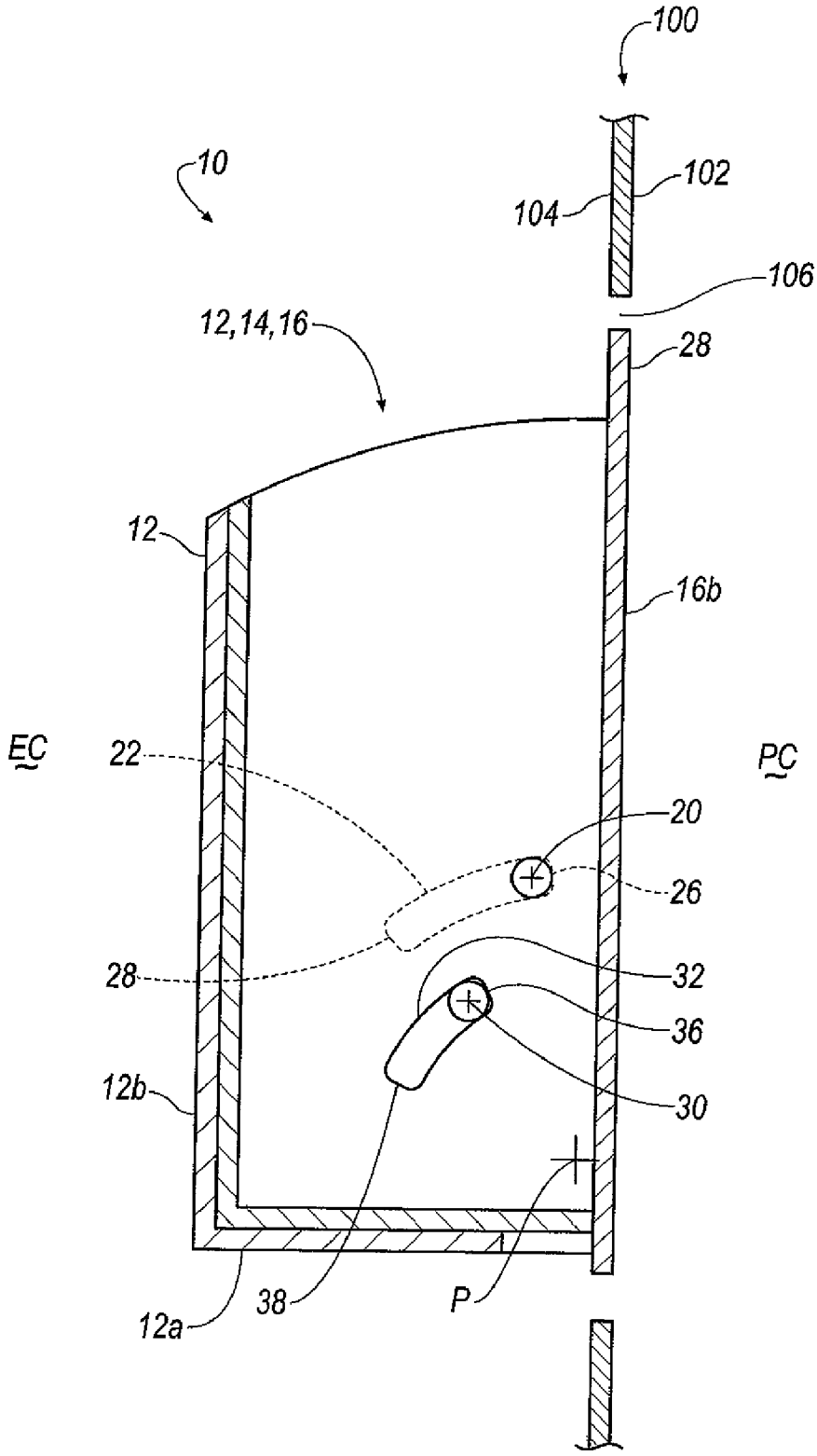
FIG. 1 is a side view of an assembly including a door portion that is in a closed position relative a housing in accordance with an exemplary embodiment of the present invention.
Figure 2:
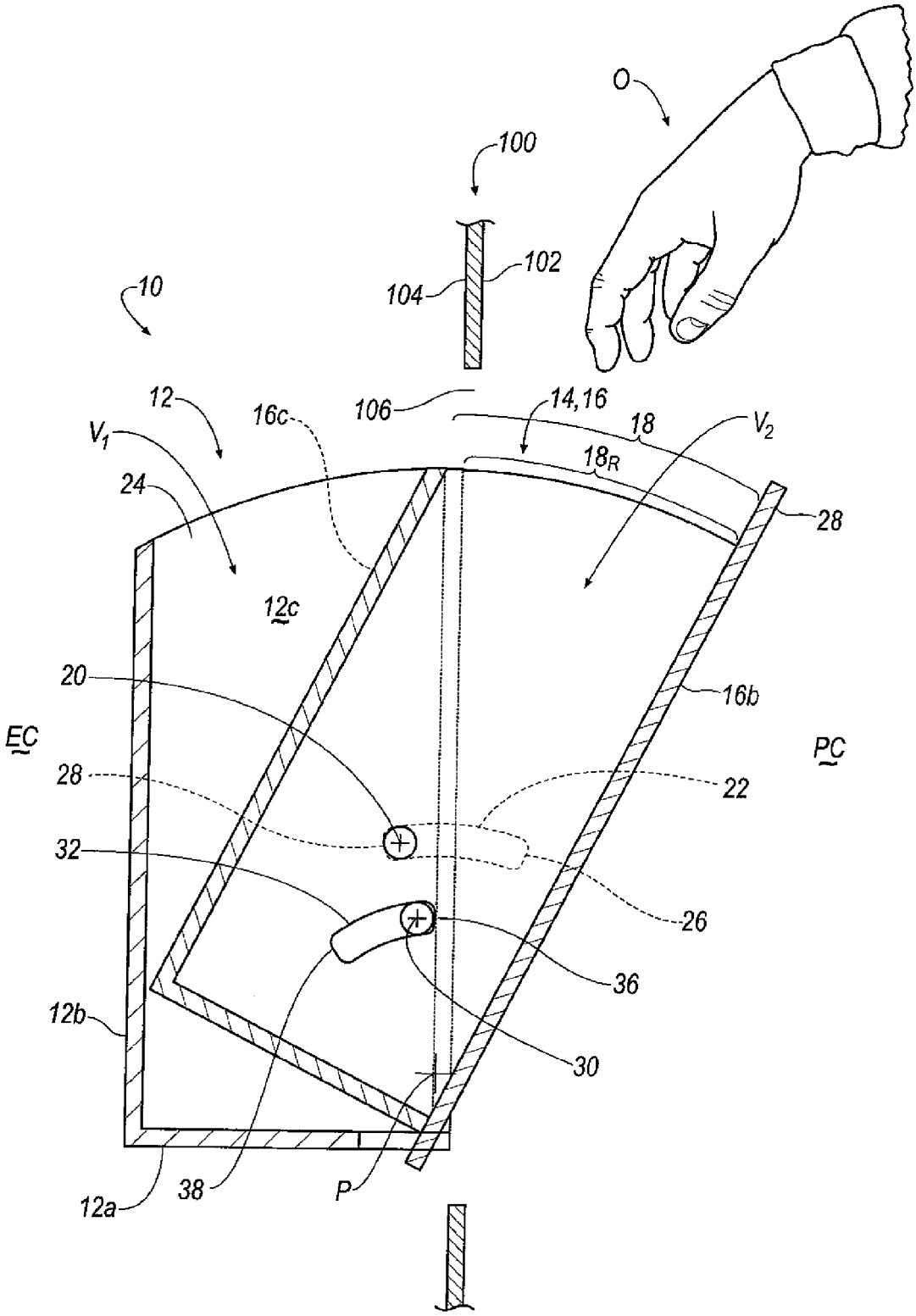
FIG. 2 is a side view of the assembly according to FIG. 1 including the door portion in an telescoped position relative the housing in accordance with an exemplary embodiment of the present invention.
Figure 3:
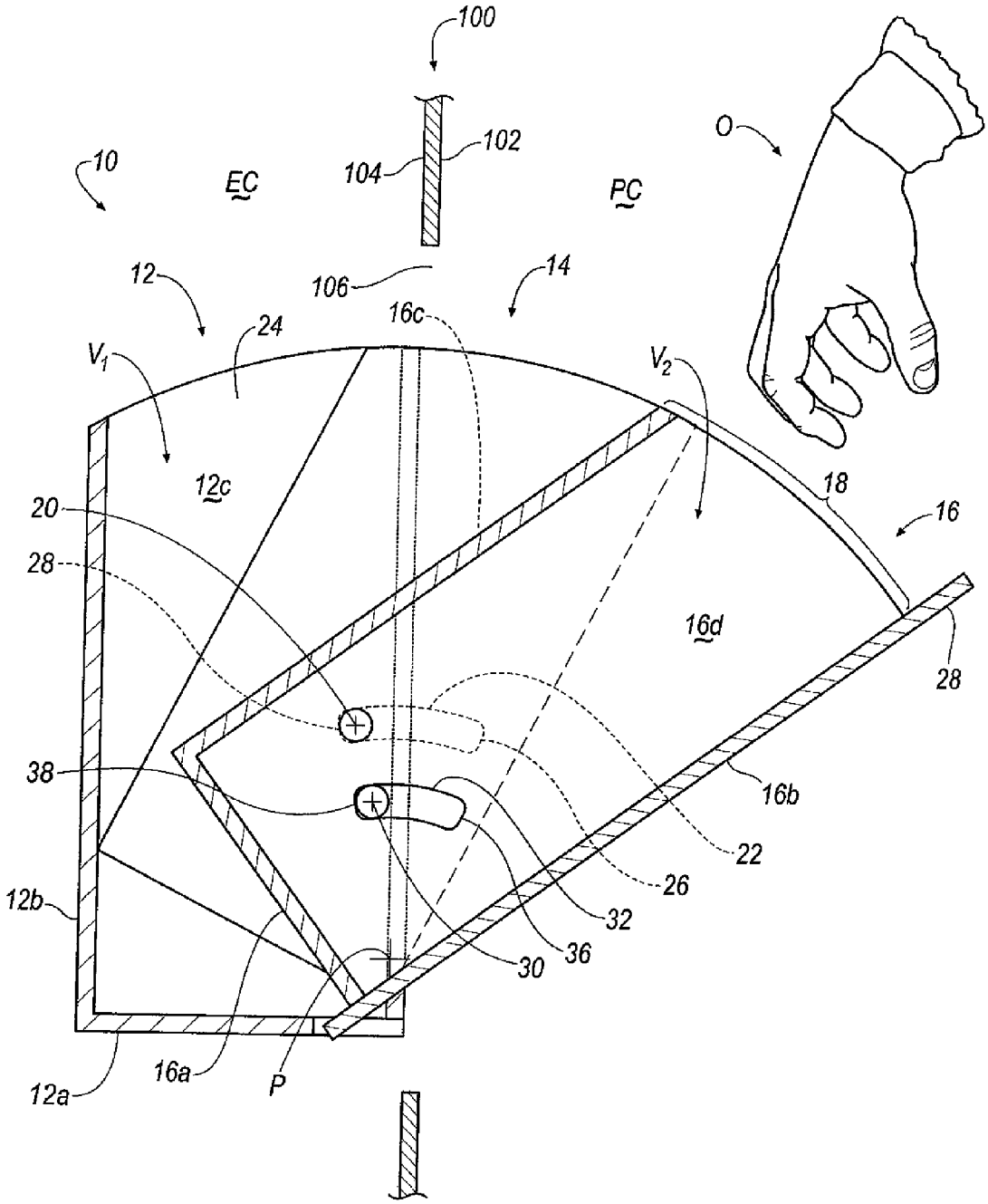
FIG. 3 is a side view of the assembly according to FIG. 1 including the door portion in an extended position relative the housing in accordance with an exemplary embodiment of the present invention.

Referring to FIGS. 1-3, an assembly is shown generally 10 according to an embodiment of the present invention. As shown in FIG. 3, the assembly 10 is generally defined to include at least a housing 12, one or more telescoping brackets 14, and a door portion 16.

The housing 12 includes a plurality of walls 12*a*-12*c* that define a cavity or volume, $V_1$ (FIG. 3). In general, the wall 12*a* may be a bottom wall. The wall 12*b* may be a rear wall. The walls 12*c* may be sidewalls. It will be appreciated that the housing 12 is not limited to a particular number of walls 12*a*-12*c*, volume, $V_1$, or a particular geometry and that the housing 12 may include any desirable number of walls 12*a*-12*c*, volume, $V_1$, or geometry.

Figure 4:
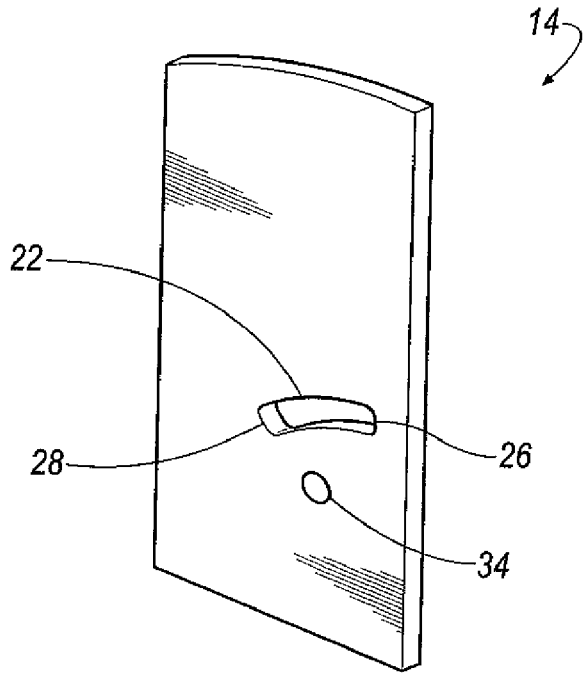
FIG. 4 is a perspective view of a telescoping bracket of the assembly illustrated in FIG. 1 in accordance with an exemplary embodiment of the present invention.

Referring to FIG. 4, the one or more telescoping brackets 14 are defined by a substantially planar member in a substantially similar geometry to that of the sidewall 12*c* of the housing 12. According to an embodiment, as seen in FIG. 1, when the door portion 16 is moved to a closed position, the one or more telescoping brackets 14 are nested within the cavity or volume, $V_1$, and positioned adjacent the sidewalls 12*c* of the housing 12.

Figure 5:
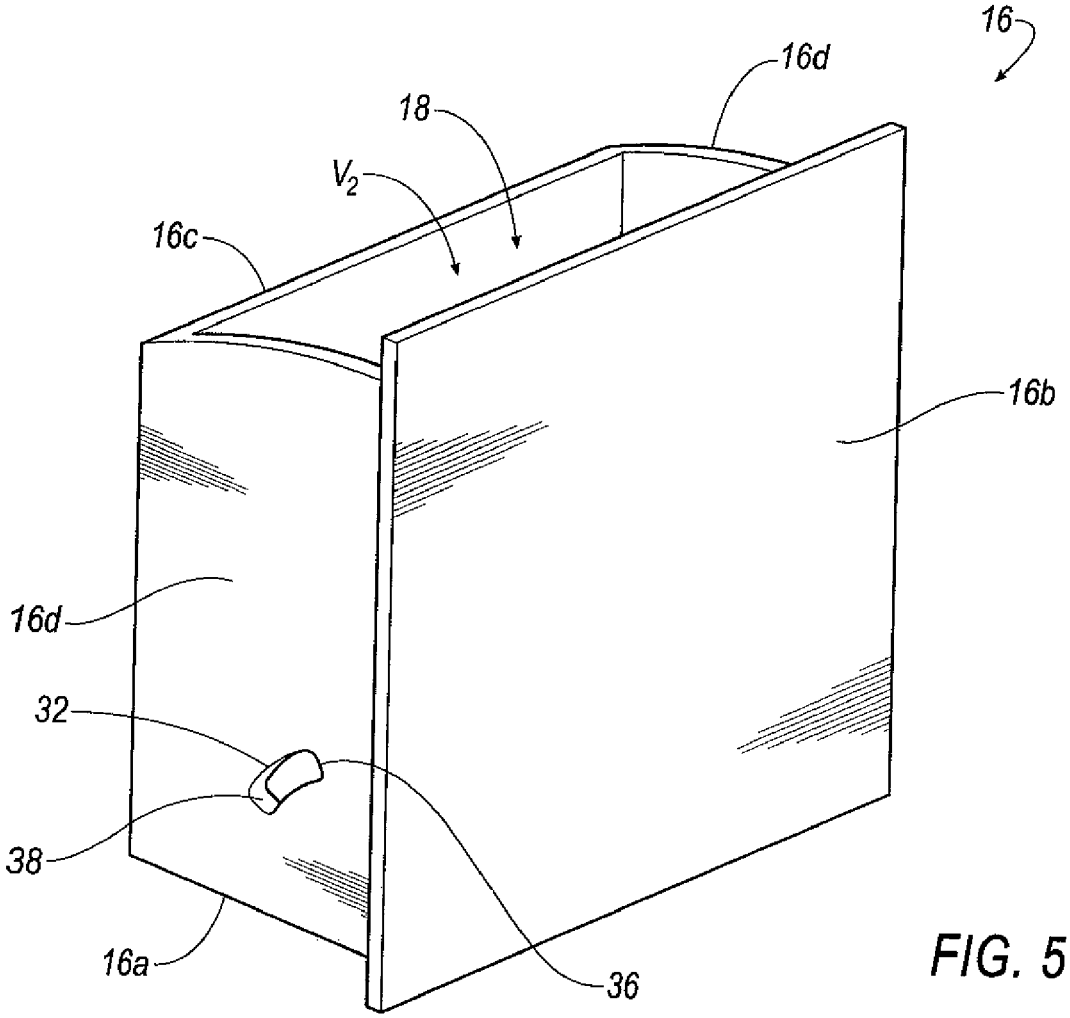
FIG. 5 is a perspective view of a door portion of the assembly illustrated in FIG. 1 in accordance with an exemplary embodiment of the present invention.

Referring to FIG. 5, the door portion 16 is defined to include a plurality of walls that are identified generally at 16*a*-16*d*. According to an embodiment, the wall 16*a* may be a bottom wall. The wall 16*b* may be a front wall. The wall 16*c* may be a rear wall. The walls 16*d* may be sidewalls. In an embodiment, the sidewalls 16*d* are each defined by a substantially planar member in a substantially similar geometry to that of the one or more telescoping brackets 14 and sidewalls 12*c* of the housing 12.

The walls 16*a*-16*d* of the door portion 16 define a sub-volume, which is shown generally at, $V_2$, Referring to FIG. 3, the sub-volume, $V_2$, is substantially equal to but less than the volume, $V_1$, of the housing 12, and, as such, when the door portion 16 is moved to the closed position, as shown in FIG. 1, the door portion 16 may be nested within the volume, $V_1$, of the housing 12.

Referring to FIG. 3, the walls 16*b*-16*d* of the door portion 12 define an opening 18. The opening 18 permits access to the sub-volume, $V_2$, for depositing or withdrawing one or more items into/from the door portion 16, which may also define a storage compartment.

In operation, as seen in FIGS. 1-3, the one or more bracket 14 and door portion 16 are moved relative the housing 12 about a pivot point, P. In an embodiment, the one or more telescoping brackets 14 and door portion 16 may be nested within the housing 12 to define the door portion 16 being in a closed position (FIG. 1). The one or more telescoping brackets 14 and door portion 16 may also be moved about the pivot point, P, to define the door portion 16 being in an extended position (FIG. 3). In addition, the one or more telescoping brackets 14 and door portion 16 may be moved about the pivot point, P, in any desirable position between the closed position and the extended position to define the door portion 16 being in an intermediate, telescoped position (FIG. 2).

Referring to FIGS. 1 and 2, movement of the one or more telescoping brackets 14 and door portion 16 about the pivot point, P, to/from the closed position (FIG. 1) and telescope d position (FIG. 2) is permitted by one or more pins 20 disposed in an arcuate slot 22 formed in the one or more telescoping brackets 14. In an embodiment, the one or more pins 20 are fixed and extend from an inner surface 24 of the sidewalls 12*c* of the housing 12. When moved to the closed position, the one or more pins 20 may abut a first end 26 of the arcuate slot 22. When moved to the telescoped position, the one or more pins 20 may abut a second end 28 of the arcuate slot 22.

Referring to FIGS. 2 and 3, movement of the door portion 16 about the pivot point, P, to/from the telescoped position (FIG. 2) and extended position (FIG. 3) is permitted by one or more pins 30 disposed in an arcuate slot 32 formed in the sidewalls 16*d* of the door portion 16. To facilitate passage of the one or more pins 30 into the arcuate slot 32, a passage 34 (FIG. 4) is formed in the one or more telescoping brackets 14. In an embodiment, the one or more pins 30 are fixed and extend from the inner surface 24 of the sidewalls 12*c* of the housing 12 and through the passage 34 formed in the one or more telescoping brackets 14 for insertion into the arcuate slot 32 formed in the sidewall 16*d* of the door portion 16. When moved to the telescoped position, the one or more pins 30 may abut a first end 36 of the arcuate slot 32. When moved to the extended position, the one or more pins 30 may abut a second end 38 of the arcuate slot 32.

It will be appreciated that the present invention is not limited to a pair of pin/slot configurations formed in the one or more telescoping brackets 14 and door portion 16 to permit movement of the door portion 16 to/from a closed, telescoped, and extended position. For example, an array of brackets 14 with a corresponding array of pins 20 and arcuate slots 22 may permit the door portion 16 to extend further away from the housing 12 than that as shown in FIG. 3.

In addition, it will be appreciated that the present invention is not limited to a pin/slot configuration to permit movement of the door portion 16 to/from a closed, telescoped, and extended position. For instance, the pin/slot configuration could be replaced by a molded ramp formed in/on one or more of the telescoping brackets 14 and door portion 16 that is used in combination with one or more wheels/rollers fixed to the inner surface 24 of the sidewalls 12*c* of the housing 12.

In addition, it will be appreciated that the present invention is not limited to a configuration having the door portion 16 connected to and nested between two or more telescoping brackets 14 (i.e., the brackets 14 are positioned on an exterior surface of the sidewall 16*d*). For instance, an assembly may include a configuration having two or more telescoping brackets 14 connected to and nested within the sub-volume, $V_2$, of the door portion 16 such that the sub-assembly defined by the nested one or more telescoping brackets 14 within the door portion 16 is then nested within the volume, $V_1$, defined by the housing 12; if such an arrangement is provided, the door portion 16 may not include a rear wall 16*c* to permit the telescoping movement of the brackets 14.

It will be appreciated that the assembly 10 may be utilized in any desirable application. For example, the assembly 10 may be incorporated into or disposed proximate an interior trim assembly 100 of an automotive vehicle. The trim assembly 100 may be, for example, dashboard trim, defining a passenger compartment surface 102 and an engine compartment surface 104. As such, the trim assembly 100 may further define a passenger compartment area, PC, and an engine compartment area, EC.

The trim assembly 100 may also include an opening 106 to permit the one or more telescoping brackets 14 and door portion 16 to be moved from the engine compartment area, EC (when the door portion 16 is in the closed position as shown in FIG. 1), into the passenger compartment area, PC (when the door portion 16 is in the extended position as shown in FIG. 3). When moved to the passenger compartment area, PC, the sub-volume, $V_2$, of the door portion 16 may define, for example, a storage compartment for stowing and retrieving any desirable item therefrom, such as, for example, maps, gloves, coins, pens, beverages, compact discs (CDs), digital music players, or the like.

It will be appreciated that the one or more telescoping brackets 14 permit the door portion 16 to telescopingly extend further away from the housing 12 to provide a vehicle occupant, O, with greater access to items that may be located within the sub-volume, $V_2$. If, for example, the one or more telescoping brackets 14 were not included in the design of the assembly 10, access to the sub-volume, $V_2$, through the opening 18 may be otherwise limited by the relative obstructive positioning of the trim assembly 100 that would otherwise define a reduced opening, which is shown, for example, at $\mathbf{18}_R$ in FIG. 2. If the opening 18 was restricted to that as shown at $\mathbf{18}_R$, it may be difficult for a vehicle occupant, O, having a relatively large hand to access items in the sub-volume, $V_2$. In addition, if an item located in the sub-volume, $V_2$, is relatively large, it may be difficult to remove the item therefrom if a reduced opening, $\mathbf{18}_R$, is provided.

The present invention has been described with reference to certain exemplary embodiments thereof. However, it will be readily apparent to those skilled in the art that it is possible to embody the invention in specific forms other than those of the exemplary embodiments described above. This may be done without departing from the spirit of the invention. The exemplary embodiments are merely illustrative and should not be considered restrictive in any way. The scope of the invention is defined by the appended claims and their equivalents, rather than by the preceding description.

What is claimed is:

1. An assembly, comprising:

a housing having a first pair of sidewalls;

a telescoping bracket movably secured to the housing including a first arcuate channel and a passage;

a door portion movably secured to the housing including a second arcuate channel;

a first pin extending from one of said first sidewalls of the housing, wherein the first pin extends into the first arcuate channel; and a second pin extending from said one sidewall of the housing, wherein the second pin extends through the passage of the telescoping bracket and into the second channel.

2. The assembly according to claim 1, wherein the housing includes a first end wall and said first pair of sidewalls extending from the first end wall to define a volume, wherein the door portion includes a second end wall and a second pair of sidewalls extending from the second end wall to define a sub-volume that is less than but approximately equal to the volume of the housing.

3. The assembly according to claim 2, wherein the telescoping bracket and second pair of sidewalls include a substantially similar geometry to that of the first pair of sidewalls of the housing to permit the telescoping bracket and door portion to be received by and nested within the volume defined by the housing.

4. The assembly according to claim 2, wherein the door portion includes a bottom wall and a front wall, and wherein the end wall, second pair of sidewalls, bottom wall, and front wall further define a storage compartment, and further wherein the front wall, end wall and second pair of sidewalls define an opening to the storage compartment.

5. An assembly, comprising:

a housing having a first pair of sidewalls;

a door portion movably secured to the housing, the door portion defining a first arcuate channel; and means for telescopingly adjusting a positioning of the door portion relative a position of the housing including one or more telescoping brackets that are movably secured to the housing, wherein at least one of the one or more telescoping brackets includes a second arcuate channel and a passage, and wherein the door portion is movably secured to the housing and the one or more telescoping brackets;

a first pin extending from one or both of the pair of sidewalls of the housing, wherein the first pin extends through the first arcuate channel of the one or more telescoping brackets; and a second pin extending from one or both of the pair of sidewalls of the housing, wherein the second pin extends through the passage of the one or more telescoping brackets and the second arcuate channel of the door portion.

6. The assembly according to claim 5, wherein the housing includes a first end wall and said first pair of sidewalls extending from the first end wall to define a volume, and wherein the door portion includes a second end wall and a second pair of sidewalls extending from the second end wall to define a sub-volume that is less than but approximately equal to the volume.

7. The assembly according to claim 6, wherein the one or more telescoping brackets and second pair of sidewalls of the door portion define a substantially similar geometry to that of the first pair of sidewalls of the housing to permit the one or more telescoping brackets and door portion to be received by and nested within the volume defined by the housing.

8. The assembly according to claim 6, wherein the door portion includes a bottom wall and a front wall, and wherein the end wall, second pair of sidewalls, bottom wall, and front wall further define a storage compartment, and further wherein the front wall, end wall and second pair of sidewalls define an opening to the storage compartment.

* * * * *